United States Patent [19]

Medley

[11] 3,939,768

[45] Feb. 24, 1976

[54] CHARACTER BELT APPARATUS WITH REPLACEABLE SLUGS FOR LINE PRINTER

[75] Inventor: Harold C. Medley, Los Gatos, Calif.

[73] Assignee: Shugart Associates, Sunnyvale, Calif.

[22] Filed: Apr. 26, 1974

[21] Appl. No.: 464,472

[52] U.S. Cl. ..... 101/111; 101/111

[51] Int. Cl.[2] ..... B41J 1/20

[58] Field of Search ..... 101/111, 93 C, 105

[56] References Cited

UNITED STATES PATENTS

| | | | |
|---|---|---|---|
| 1,472,282 | 10/1923 | Smith | 101/111 |
| 1,974,369 | 9/1934 | Shomaker | 101/111 |
| 3,041,965 | 7/1962 | Sasaki | 101/111 |
| 3,113,509 | 12/1963 | Simpson | 101/111 |
| 3,667,384 | 6/1972 | Sniderman | 101/111 |
| 3,805,698 | 4/1974 | Bowers et al. | 101/111 |

*Primary Examiner*—Edgar S. Burr
*Assistant Examiner*—Edward M. Coven
*Attorney, Agent, or Firm*—Schatzel & Hamrick

[57] ABSTRACT

Character belt apparatus for use on a line printer and including a thin, flexible metal belt formed into an endless band for carrying replaceable character slugs affixed thereto at regular intervals. Each character slug has a front side on which an alphanumeric character is provided and a rear side which is recessed in a particular manner so as to mate with a mounting and fastening element that is itself affixed to the belt by spot welding or the like. Although the fastening mechanism of the element may vary from embodiment to embodiment, in each case the matingly engaging surfaces of the element and slug provide for accurate positioning of the slug relative to the belt in both the longitudinal and transverse belt directions. In one embodiment a screw is used to fasten the slug in registration with a nut type element plate. In second and third embodiments, spring clip type elements mount and affix specially adapted character slugs to the belt.

10 Claims, 7 Drawing Figures

CHARACTER BELT APPARATUS WITH REPLACEABLE SLUGS FOR LINE PRINTER

BACKGROUND OF THE INVENTION

1. Field of the Invention

The present invention relates generally to character belt apparatus for use in line printers and more particularly, to an improved character belt apparatus having individually replaceable character slugs that are secured to and in registration with the belt.

2. Description of the Prior Art

In printers of the type used in data processing equipment, a movable endless belt supporting a plurality of type characters is moved continuously past a print line at a constant rate of speed. The type characters are equally spaced from one another and are precisely located on the belt in a single lateral track. In such printing devices, a bank of print hammers is mounted such that it can be caused to strike a selected character during the rotation of the belt in response to appropriate control signals. A print medium, such as a web of paper is fed incrementally, step by step, past the print line so as to enable the aligned bank of print hammers to appropriately impact the print. Accordingly, each hammer, when actuated, strikes the back of the paper and forces the paper against the character on the band. Because of the relative movement of the type characters on the belt and the print hammers, it will be appreciated that the character must be in precisely the expected location on the belt or misprinting will result. After a character belt has been in use for some time, wear problems have been encountered due to the continual pounding it experiences from the print hammers. It has also been observed that certain alphanumeric characters are used more frequently than others and consequently, tend to wear at a quicker rate.

One type of character belt used in date processing printers is fabricated from a fiberglass-reinforced rubber timing belt currently manufactured by the United States Rubber Company. At the upper and lower ends of each of the character slugs are rearwardly-extending undercut portions defining mutually facing ledges which are spaced apart by a distance substantially the same as the width of the belt. Accordingly, to assemble the character slugs on the belt, it is necessary to compress the belt slightly across its width, move the character slug into place and then release the belt so that the edges thereof move into the space between the rear wall portions and the front portion of the character slug. However, it is relatively expensive to fabricate this belt in view of the time required to individually assemble each character slug on the belt. Moreover, because of the resilient properties of the rubber, it was found that the location of each slug changed continuously as a function of the stretching of the belt.

Another type of character belt is formed by etching a single metal substrate and butt welding the ends together into an endless band. In fabricating this belt, a relatively thick band of metal has portions of its surface selectively etched away so as to define a set of raised characters. However, after usage it has been found that some of the more frequently-used characters wear away. Since the characters are formed integrally with the belt, the whole belt must be scrapped. Since the worn characters are not replaceable and in view of the accuracy of the etching operations that are required to form the characters, it is easily recognized that such a belt must be frequently replaced and is expensive to purchase.

Examples of printing belts are found in U.S. Pat. No. 2,928,896, entitled "High Speed Printing Devices," which issued Mar. 15, 1960, in the same name of Gerhard Dirks; U.S. Pat. No. 2,940,385, entitled "High Speed Printer," which issued June 16, 1960, in the name of Frank R. House; and U.S. Pat. No. 3,402,657, entitled "High Speed Belt Printer with Printing Slug Supporting Means," which issued Sept. 24, 1968, in the names of John T. Potter, Thomas P. Foley and Carmine J. Antonucci.

SUMMARY OF THE INVENTION

It is therefore an object of the present invention to provide a line printer character belt apparatus in which the character slugs are individually replaceable units.

Another object of the invention is to provide a character belt apparatus of the type described which has a long useful life and is therefore relatively inexpensive.

Still another object of the present invention is to provide a character belt apparatus of the type described which can include a character set that is tailored to the needs of a particular customer.

Briefly, the present invention is directed toward a character belt apparatus for use on a line printer and includes a thin flexible metal belt formed into an endless band, a plurality of slug mounting elements affixed at predetermined locations along the outer surface of the belt, and a plurality of replaceable character slugs each having a front face upon which an alphanumeric character is provided and a rear face which is recessed to mate with a mounting element. The mounting elements include a body portion having a pair of sides forming a pair of longitudinal registration surfaces, means for providing slug-belt registration in the transverse directions, and fastening means for securing the slug to the mounting element. Apertures are provided in the belt between adjacent character slugs to relieve stresses set up in the belt due to the continuous bending that the belt experiences while traveling about the drive pulleys.

In a first embodiment the slug mounting element comprises a nut plate including top and bottom tabs which mate with corresponding surfaces of the slug to provide vertical registration of the slug in a direction transverse to the belt. In addition, the nut plate is tapped and threaded to receiving a screw which passes through an aperture in the slug to secure the slug to the nut plate.

In other embodiments, clip springs serve as the mounting elements as well as the fastener. In these embodiments, one end of the spring clip is looped and formed to resiliently engage the front face of the character slug and hold it in engagement with another portion of the clip which is affixed to the belt.

One advantage of the present invention is that it inexpensively allows the individual replacement of worn or damaged character slugs.

Another advantage of the present invention is that it provides a character belt which may be inexpensively tailored to the individual needs of a particular customer in that special character sets may be arranged upon the belt in any desired sequence.

Still another advantage of the present invention is that it provides for removable character slugs which are accurately located at equally spaced intervals on the outer surface of a flexible metal belt.

Still another advantage of the present invention is that the flexible metal character belt is stress-relieved to minimize the occurrence of belt fatigue at the character attachment locations.

Other objects and advantages will be apparent to those skilled in the art after having read the following detailed disclosure of the preferred embodiments illustrated in the several figures of the drawing.

IN THE DRAWING

DETAILED DESCRIPTION OF THE PREFERRED EMBODIMENT

Figure 1:
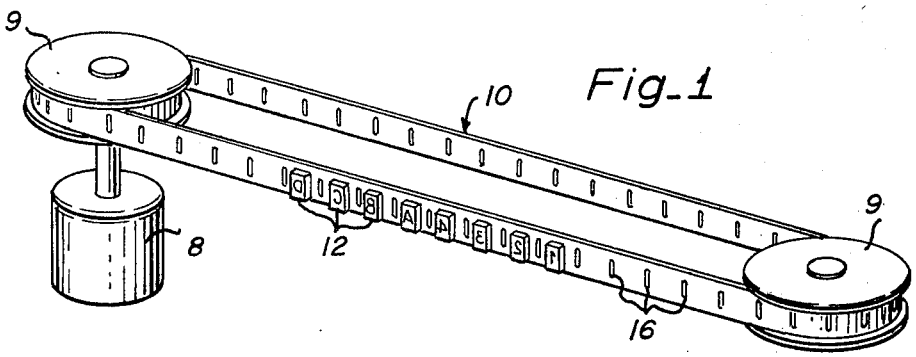
FIG. 1 is a diagrammatic perspective view of a character belt apparatus and belt driving mechanism in accordance with the present invention.

Referring now to the drawings, and in particular, to FIG. 1 thereof, the character belt apparatus of the present invention is illustrated. As shown therein, the character belt 10 is in the form of an endless band positioned on a belt-driving mechanism including a pair of spaced-apart pulleys 9 which are rotatably driven by motor 8. As will be specified in more detail below, belt 10 carrys a plurality of character slugs 12 which are used to print alphanumeric characters. Upon energization of the motor 8 the belt 10 is continuously driven past a bank of print hammers (not shown) positioned in the foreground and selectively energized so as to strike one of the character slugs 12 through a sheet or strip of paper passed therebetween. The slugs 12 are individually removable and are affixed to the outer surface of the belt in a manner which will be hereinafter described.

In compliance with one industry standard, 64 alphanumeric characters comprise a character set. In the preferred embodiment of the present invention two such sets are affixed in sequence around the band such that the belt includes 128 characters. On most bands, 26 of the character slugs are used to represent the letters of the alphabet and 10 slugs are used to represent numbers. The remaining 28 characters are designated as being special characters and may include punctuation marks and arithmatic symbols as well as many of the more frequently-used letters and numbers.

Figure 2:
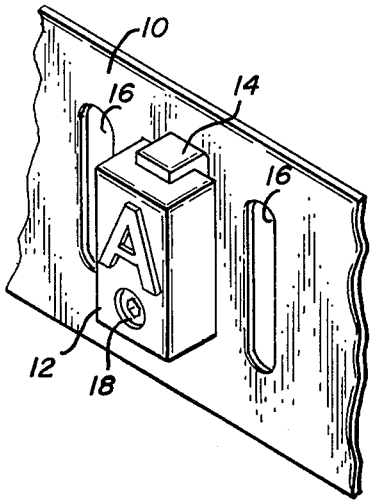
FIG. 2 is a fragmentary perspective view of a portion of the character belt apparatus of FIG. 1.
Figure 3:
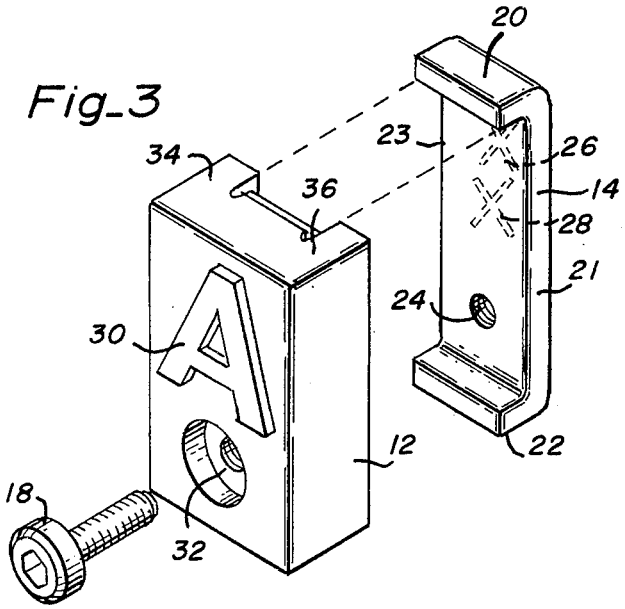
FIG. 3 is an exploded view of one embodiment of a character slug and fastening element in accordance with the present invention.

Referring to FIGS. 2 and 3, a first embodiment of the present invention is illustrated. The belt 10 comprises a thin flexible metal that is formed into an endless band perforated with apertures 16 having a substantially oval shape. The apertures 16 are equally spaced from one another at preselected intervals along the length of the belt and serve to relieve stresses set up in the metal belt at the character attachment areas as it is bent around the pulleys 9. Since the slugs 12 are precisely located with respect to the apertures, the apertures may be used as a means which can be detected to develop a clocking pulse for controlling the timing between the character position and the print hammer actuation. In the preferred embodiment, the belt is a strip of stainless steel joined together at its ends by well known lap welding techniques. The particular stainless steel used may be any of the high strength alloys which have been tempered or heat-treated to provide the required tensile strength. Materials such as 301, 410 and 17-7PH stainless steel are satisfactory.

A character slug assembly is secured to the belt between adjacent apertures 16 and is comprised of a character slug 12, a nut plate 14, which serves to mount the slug to the belt 10, and a screw 18 for securing the character slug 12 to the nut plate 14. As shown in FIG. 3, the nut plate 14 is generally C-shaped in configuration and includes top and bottom tabs 20 and 22, also referred to as flanges, which protrude outwardly from opposite ends of the body portion of the nut plate. The opposing edges 21 and 23 of the body portion are parallel to one another and serve to define a pair of registration surfaces for accurately positioning a slug longitudinally relative to the belt. The nut plate is precisely affixed to the belt 10 between the apertures 16 by spot welds 26 and 28 such that the side edges 21 and 23 of the body portion are aligned substantially normal to the length of the belt and parallel to the respective side edges of all of the other nut plates so that the distance between the respective edges of adjacent nut plates is precisely controlled. Beneath the weld 28 is a threaded hole or aperture 24 which is centered between the edges 21 and 23, and spaced a predetermined distance up from the bottom tab 22. In the preferred embodiment, the nut plate is fabricated from a low carbon steel.

The character slug 12 has a front face with an alphanumeric character 30 provided in the upper portion and a counter-sunk hole 32 provided in the lower portion. The slug 12 is channel-shaped so as to include side flanges 34 and 36. The distance between the inner surfaces of the flanges 34 and 36 is slightly greater than that between the edges 21 and 34 of the nut plate 14 such that the character slug fits snugly against the edges 21 and 23 to provide accurate longitudinal registration of the slug with respect to the belt 10. For simplicity, longitudinal registration of the slug 12 will hereinafter be referred to as horizontal positioning or registration.

The height of character slug 12 slightly less than the distance between the tabs 20 and 22 so as to provide registration of slug 12 in the transverse direction relative to belt 10. For simplicity, this registration will hereinafter be referred to as vertical positioning or registration. The character slug is preferably made of carbon steel which has been case-hardened. The screw 18 is inserted through the hole 32 and threaded into hole 24, and secures slug 12 to nut plate 14. Once the screw is tightened, horizontal and vertical registration is effected and rotational misalignment between the slug and the nut plate is prevented.

Figure 4:
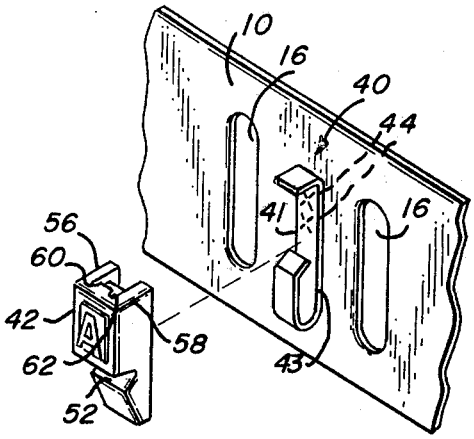
FIG. 4 is a fragmentary perspective view of a second embodiment of a character slug and fastening element in accordance with the present invention.
Figure 6:
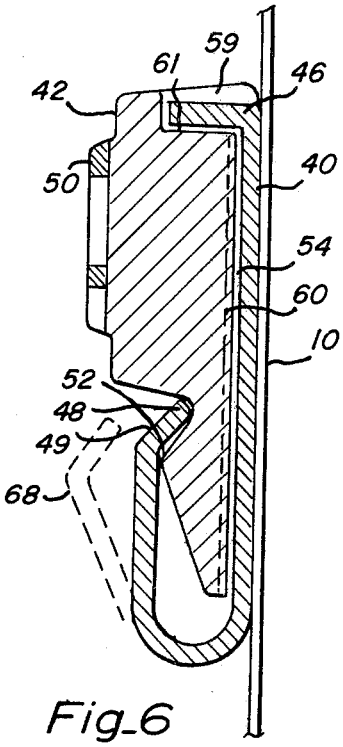
FIG. 6 is a side sectional view taken through lines 6–6 of FIG. 5.
Figure 5:
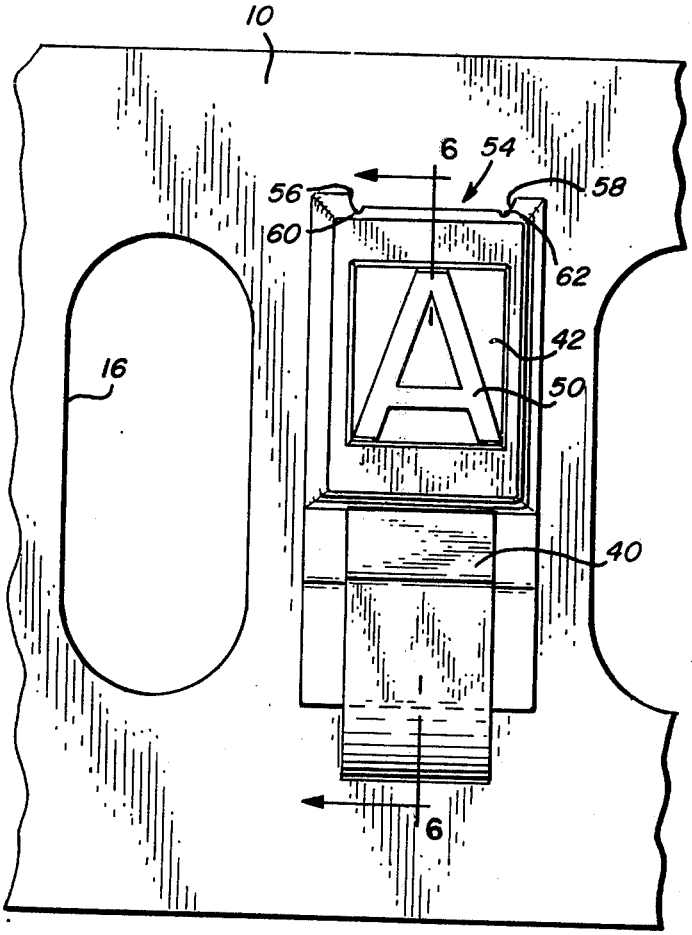
FIG. 5 is a front elevational veiw of a portion of the embodiment illustrated in FIG. 4.

Referring now to FIGS. 4 through 6, another embodiment of the present invention is illustrated. The fundamental difference between the embodiment of FIGS. 4 through 6 and the embodiment of FIGS. 2 and 3 is that the mounting and fastening element of FIGS. 4 through 6 is comprised of a spring clip 40 formed such that the spring force of the clip biases the character slug 42 into mating engagement with the aligning portion of the clip to hold it in registration as well as to attach it to the belt.

The spring clip 40 is fabricated from a resilient metal, preferably a tempered stainless steel, with a uniform width that is held to a tolerance of .001 inches so that its side edges 41 and 43 define horizontal registration surfaces for engagement with the character slug 42, as will be described below. The body of the spring clip 40 is secured to belt 10 at a preselected location between the apertures 16 with spot welds 44. Spring clip 40 is substantially J-shaped in configuration with its upper end being formed into an outwardly protruding tab 46 for engaging a corresponding vertical reference surface of the character slug 42. The other end of spring clip 40 is bent into a U-shape with the distal end 48 being bent inwardly at 49 towards the clip body at an angle of between 45° and 55°.

The character slug 42 includes a front face which is provided with an alphanumeric character 50 in its upper portion. The lower portion of the front face is notched as shown at 52 and is tapered downwardly toward the rear face as shown in the cross-section of FIG. 6. The rear face of the character slug includes a vertically-extending recess 54 which extends along the entire length of the slug. The width of the recess is slightly wider than the width of the spring clip so as to provide horizontal registration of the slug relative to the belt 10. The top portion of the rear face of the character slug is notched as shown at 59 so as to define a vertical reference surface 61 for alignment with the tab 46.

Another feature of this embodiment is the formation of parallel vertically-extending grooves 60 and 62 along the edges of the recess adjacent the side walls 56 and 58. Since the magnitude of the impact force of the hammer against the character slug is such as to momentarily stop the slug while the belt continues to move under the influence of the belt driving mechanism, rotational forces are set up between the spring clip and the slug. To accommodate such forces, grooves 60 and 62 are added to provide clearance between the slug and the registration edges 41 and 43 of the spring clip 40 so that when the print hammer impacts the character 50 of the character slug, a slight rocking action about a vertical axis is permitted. Alternatively, chamfered edges could be provided on the character slug to accomplish the same purpose. Because the character is mounted on a flexure which permits a slight rotational movement, the rotational forces do not harmfully effect the printing operation. In fact, the slight rotational movement tends to reduce smearing caused by the motion of the belt.

In mounting the character slug 42 to the spring clip 40, the walls 56 and 58 of the slug are aligned with the horizontal registration surfaces of the clip, and the slug is urged downwardly until the lower portion of the slug engages the inwardly-directed end 48 of the clip. Continued urging causes the tapered surface of the slug to force the spring back to a position such as illustrated by the dashed lines 68 in FIG. 6. As soon as the edge of notch 52 clears the tab 46 of the spring, the slug will snap into place and pressure can be released. At this time the bias force of the spring which is directed upwardly and inwardly at the end 48 forces the vertical registration surface 60 of the slug against the tab 46 and maintains the grooves 60 and 62 in registration with the horizontal registration surfaces of the spring clip. To remove the slug, the slug is pulled outwardly away from belt 10 causing the notch 59 to move out of engagement with the tab 46.

In the preferred embodiment, the spring clip is 10 mils thick and 0.125 inches wide, and has a tolerance of 0.001 inches. The grooves are 8 mils deep and 0.127 inches wide between the inside edges of sides 56 and 58.

Figure 7:
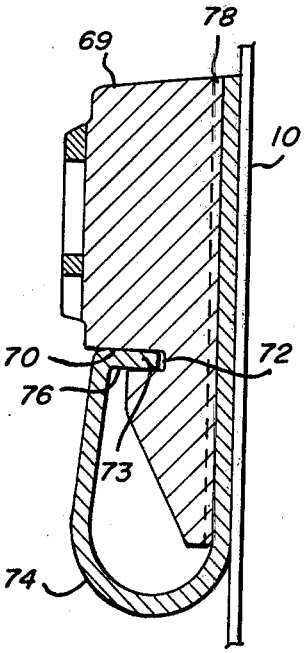
FIG. 7 is a side sectional view of a third embodiment of a character slug and fastening element in accordance with the present invention.

In a third embodiment illustrated in FIG. 7, the front face of a character slug 69 is recessed as shown at 70 so as to define a locating groove 72 which has a controlled width that is slightly greater than the thickness of the spring clip 74. The spring clip is bent so as to extend in a U-shape around the bottom of the slug and is bent inwardly as shown at 76 such that its end is biased inwardly in a direction substantially normal to the locating surface 72 and to the outer surface of the belt 10. Thus, when the character slug is snapped into the spring clip in the same manner as was the previous embodiment, the spring force exerted by the end 73 against the character slug is such as to prevent movement in the vertical direction, thereby securing the slug in vertical registration. Horizontal registration is effected by the snug fit between the width of the clip and the inside edges of a vertical groove provided in the rear face of the slug similar to that of the previously described embodiment. The tab portion of the embodiment shown in FIGS. 4 through 6 has been eliminated in this embodiment and advantageously eliminates the precise tolerance requirements in manufacturing the spring clip.

It will thus be seen that several important features and characteristics are provided in accordance with the present invention. For example, the particular manner in which the slugs are attached to the belt together with the manner in which the apertures are provided in the belt result in highly accurate and repeatable positioning of the slugs when in the printing position, yet permits a relatively large degree of belt flexibility as a particular belt segment rounds a drive or idler pulley. Furthermore, the limited freedom of the slugs to rotate about a vertical axis as permitted by the vertical groove 60 and 62 enables full character-hammer contact to insure uniform printing while at the same time reducing the tendency to smear due to the relative motion between character and paper during the print operation.

While several embodiments of character belt apparatus having individually replaceable character slugs fulfilling all of the objects and advantages set forth have been described above in what is at present considered to be preferred embodiments of this invention, it will be understood that various additional modifications may be made therein, and it is intended that the appended claims cover all such modifications that fall within the true spirit and scope of the invention.

What is claimed is:

1. Character belt apparatus for use on a line printer, comprising:

a flexible belt formed into an endless band;

a plurality of elongated slug mounting elements, each such mounting element including a body portion affixed to the outer surface of said belt and vertical registration means formed by at least one extremity of the elongated mounting element turned so that at least a terminal portion of said one extremity extends normal to said body portion and to the outer surface of said belt to define at least one horizontally extending vertical registration surface, said body portion having parallel side edges oriented transverse to the length of said belt to define a pair of horizontal registration surfaces;

a plurality of replaceable character slugs, each such slug including a front face on which on alphanumeric character is provided and a rear face having a recess extending vertically therealong to mate with and receive said body portion, the horizontal boundaries of said recess being formed by a pair of opposed spaced-apart vertically extending surfaces for engaging said horizontal registration surfaces to provide horizontal registration of said slug relative to said belt, each such slug also including at least one horizontally extending surface for mating with said vertical registration surface to provide vertical alignment of said slug relative to said belt; and slug fastening means for securing each of said character slugs to corresponding ones of said mounting elements.

2. Character belt apparatus as recited in claim 1 wherein said vertical registration means further includes a second extremity of said elongated mounting element turned normal to said body portion and to the outer surface of said belt to form a second horizontally extending vertical registration surface, and wherein said slug further includes a second horizontally extending surface for mating with said second vertical registration surface.

3. Character belt apparatus as recited in claim 2 wherein said slug has a single aperture formed therein, and wherein said slug fastening means includes a single tapped hole formed in said body portion and a single screw adapted to pass through said aperture and thread into said tapped hole to secure said slug to said body portion.

4. Character belt apparatus as recited in claim 1 wherein said slug has a horizontally extending notch provided in the front face thereof, and wherein said slug fastening means is formed by a second extremity of said mounting element which is turned to wrap around a portion of said slug so that its distal end mates with said notch, said second extremity being sprung to apply a force to said slug tending to hold it in engagement with said body portion.

5. Character belt apparatus as recited in claim 4 wherein the distal end of said second extremity forms a second vertical registration surface, and wherein one of the slug surfaces forming said notch forms a second horizontally extending surface for mating with said second vertical registration surface.

6. Character belt apparatus as recited in claim 4 wherein said portion of said slug is tapered to provide a camming surface for enabling the tapered portion to be forced between said body portion and said distal end until said notch is mated with said distal end.

7. Character belt apparatus as recited in claim 1 wherein said one extremity of said elongated mounting element is turned so that its distal end is spaced from and faces said body portion and wherein said one extremity also forms a second horizontally extending vertical registration surface, and wherein said slug includes a second horizontally extending surface for mating with said second vertical registration surface, said second horizontally extending surface being spaced apart from said one horizontally extending surface to form a horizontally extending slot in said front face receiving the distal end of said one extremity.

8. Character belt apparatus as recited in claim 7 wherein each said elongated mounting element includes a U-shaped portion which couples said one extremity to said body portion, said U-shaped portion cooperating with said one extremity and said slot to form said slug fastening means.

9. Character belt apparatus as recited in claim 8 wherein said U-shaped portion in sprung to apply a force to said slug tending to hold it in engagement with said body portion, and wherein one end of said slug is tapered to provide a camming surface for enabling the tapered portion to be forced between said body portion and said distal end until said slot is mated with said distal end.

10. Character belt apparatus as recited in claim 1 wherein said belt is metal and said mounting elements are affixed to said belt by spot welds, and wherein vertically-elongated apertures are provided in said belt on each side of said mounting elements, the vertical lengths of said apertures being more than one half the vertical length of each said mounting element.

* * * * *

UNITED STATES PATENT OFFICE

CERTIFICATE OF CORRECTION

Patent No. 3,939,768 Dated February 24, 1976

Inventor(s) Harold C. Medley

It is certified that error appears in the above-identified patent and that said Letters Patent are hereby corrected as shown below:

Column 2, line 5, delete the word "same".

Column 4, line 49, after "12" and before "slightly" insert --is--.

Column 8, line 23, before "receiving" insert --for--.

Signed and Sealed this first Day of June 1976

[SEAL]

Attest:

RUTH C. MASON
*Attesting Officer*

C. MARSHALL DANN
*Commissioner of Patents and Trademarks*